US008567296B2

(12) United States Patent
Coucke

(10) Patent No.: US 8,567,296 B2
(45) Date of Patent: Oct. 29, 2013

(54) SUPPORT BRACKET FOR MANUALLY OPERATED VEGETABLE CUTTING UTENSILS

(75) Inventor: Didier Coucke, Lyaud (FR)

(73) Assignee: Bron Coucke S.A. (FR)

( * ) Notice: Subject to any disclaimer, the term of this patent is extended or adjusted under 35 U.S.C. 154(b) by 255 days.

(21) Appl. No.: 12/904,660

(22) Filed: Oct. 14, 2010

(65) Prior Publication Data

US 2011/0083329 A1 Apr. 14, 2011

(30) Foreign Application Priority Data

Oct. 14, 2009 (FR) ..... 09 57194

(51) Int. Cl.
*B26D 7/22* (2006.01)
*B26D 7/26* (2006.01)

(52) U.S. Cl.
USPC ..... 83/856; 83/857; 83/699.51

(58) Field of Classification Search
USPC ..... 83/856, 932, 858, 857, 699.51, 699.61; 30/297, 296.1, 278, 280, 279.6; 248/175; D7/693, 678, 673
See application file for complete search history.

(56) References Cited

U.S. PATENT DOCUMENTS

| | | | | |
|---|---|---|---|---|
| 888,287 | A * | 5/1908 | Williams | 83/858 |
| 5,810,299 | A * | 9/1998 | Poulos | 248/96 |
| 6,732,622 | B2 * | 5/2004 | Vincent | 83/247 |
| 7,107,890 | B2 * | 9/2006 | Vincent | 83/247 |
| 7,621,207 | B2 * | 11/2009 | Botsai et al. | 83/698.11 |
| 7,690,285 | B2 * | 4/2010 | de Buyer | 83/247 |
| 7,837,137 | B2 * | 11/2010 | Klotz et al. | 241/95 |
| 8,151,678 | B2 * | 4/2012 | Mah et al. | 83/397 |
| 8,231,086 | B1 * | 7/2012 | Starner | 248/163.1 |
| 2005/0061124 | A1 * | 3/2005 | Vincent | 83/247 |
| 2007/0137457 | A1 * | 6/2007 | Botsai et al. | 83/858 |
| 2010/0263514 | A1 * | 10/2010 | Mah et al. | 83/856 |

* cited by examiner

*Primary Examiner* — Omar Flores Sanchez
(74) *Attorney, Agent, or Firm* — Cantor Colburn LLP

(57) ABSTRACT

A manually operated vegetable cutting utensil having a stand for keeping it in an inclined position on a horizontal worktop, where a support bracket, in particular in the form of a stirrup, installed at the bottom of the stand of the utensil is provided to butt, in the use position, against an edge of the worktop so as to stabilize the utensil even if the worktop is wet or greasy.

4 Claims, 4 Drawing Sheets

SUPPORT BRACKET FOR MANUALLY OPERATED VEGETABLE CUTTING UTENSILS

TECHNICAL FIELD

The present invention relates generally to manually operated vegetable cutting utensils, of the type known as a "mandolin", which are used mainly in professional kitchens on a horizontal worktop. More particularly, this invention relates to a support bracket for such vegetable cutting utensils, said support bracket being intended to improve the stability of these utensils while they are being used.

BACKGROUND

Manually operated vegetable cutting utensils, such as those described in the patents FR 2726780 and US 2005/0061124, are generally used, in professional kitchens, on horizontal worktops that can be made of stainless steel, wood, marble, etc. In a kitchen, on account of the effected cooking activities in which water and fatty materials are widely used, these worktops are generally damp and/or greasy and thus very slippery, thus making the stability of said utensils and the ability to keep them immobile while they are being used very poor.

Although these utensils are already very often equipped with feet or other non-slip lower parts, these prove to be ineffective to a greater or lesser degree, whatever material they are made of, on smooth or even non-smooth surfaces, as soon as these surfaces are not dry or free of fatty bodies.

More particularly, when the vegetable cutting utensils of the "mandolin" type are in the work position, their cutting parts are usually located in an inclined plane at an angle of around 35 to 40 degrees with respect to the horizontal worktop. Thus, during use, forces caused by the pushing of the vegetables to be cut against the cutting parts have a horizontal component which tends to cause a forward movement of these utensils, this movement being made easier when the surface of the worktop is slippery.

Such instability can thus be dangerous for the user. This is because, although these manually operated utensils are mostly delivered with safety devices to avoid the user handling the vegetables or fruits directly with his fingers, and thus risking cutting himself, the slicing blades of these utensils remain accessible and are not out of reach of the user's fingers. Thus, if the utensil slips while it is being used, the user incurs a not insignificant risk of injuring his fingers and hands.

This instability also limits the productivity of the instruments in question. This is because the user is required to constantly keep an eye on the position of his utensil, and reposition it if necessary on the worktop, instead of concentrating on the action of cutting vegetables with to and fro movements, thereby causing slowdowns and losses of time.

BRIEF SUMMARY

The present invention aims to avoid all the drawbacks explained hereinabove and therefore has the aim of making these utensils perfectly stable and immobile and therefore easy and practical to use, fully productive and having maximum safety for the user, whatever the nature, the material and the surface state of the worktop on which they will be used. More particularly, the invention is direct to the following:

- to make these utensils easier and more practical to use, knowing that it is easier to work with a properly immobilized utensil, thereby enabling the utensil user to concentrate on his task and also to remember the position in space of the potentially dangerous cutting parts of the utensil;
- also to make these utensils fully productive, by avoiding the user having to constantly reposition the utensil on the worktop, and by keeping this utensil in a suitable, i.e. ergonomic and comfortable, work position, enabling him to meet full productivity;
- finally to make these instruments safe by immobilizing them effectively even on a wet and/or greasy worktop or other substrate, and by stabilizing them even if they are subjected to more or less substantial longitudinal and/or transverse forces while vegetables or fruits are being cut, so as to protect the fingers and hands of the user from the risks of cuts or other injuries.

To this end, the subject of the invention is a support bracket for manually operated vegetable cutting utensils, more particularly a utensil having a stand for keeping it in an inclined position on a horizontal worktop, or other substrate, while it is used, this support bracket being installed at the bottom of the stand of the utensil and being provided to butt, in the use position, against an edge of the worktop or other substrate, such as a container, so as to stabilize the utensil.

In a preferred embodiment of the invention, the support bracket is made of metal wire bent to form a stirrup, the two side arms of which are mounted, able to pivot about a transverse axis, on respective side parts of the stand of the utensil.

Thus, the support bracket is in the form of a stirrup able to pivot between a deployed use position and a folded-away storage position, the form of the stirrup being examined to adapt to the existing stand and to the different usual forms and thicknesses of the rims of worktops.

Advantageously, the two side arms of the stirrup forming the support bracket each comprise:

- a free end bent at right angles and inserted into a hole pierced into the corresponding side part of the stand of the utensil, so as to produce the transverse axis for pivoting of the stirrup,
- a curved mid-part able to rest under a transverse rod connecting the two side parts of the stand of the utensil so as to define an angular position of use of the support bracket, and
- a functional part, comprising in turn:
  - continuing the curved mid-part, a first portion which is approximately horizontal in the deployed use position and is able to rest on the surface of the worktop or other substrate;
  - on the other side of the first portion, a second portion which is approximately vertical in the deployed use position, this second portion being able to press against the edge of the worktop or other substrate.

By virtue of such a configuration, the support bracket of the invention is able to rest against the rims of worktops of any form, having edges which are sharp or angled or rounded to a greater or lesser extent.

As a whole, the support bracket according to the present invention has the following advantages:

- When the utensil equipped with this support bracket is used on a damp, wet or greasy surface, the utensil is rendered perfectly stable and cannot move on the worktop, even in the event of intensive use, thereby giving great safety to such a manually operated utensil provided with slicing blades.
- The support bracket also helps to stabilize the utensil when the latter is used on a dry and clean (non-greasy) worktop.

The support bracket, produced in the form of a metal wire stirrup, in particular a stainless steel wire, constitutes a simple, compact and economic accessory which barely increases the cost of the complete utensil.

This support bracket is light and therefore does not constitute an inconvenience for the operator when the utensil equipped therewith is moved.

By virtue of its pivoting mounting, the support bracket can be folded away into the initial volume of the utensil in order to store and transport the utensil, and it therefore does not constitute an element which would increase the space requirement of the utensil.

Made of metal wire with a sufficient diameter, the support bracket itself has sufficient rigidity, providing stable support and enabling it to withstand forces transmitted to it by the stand of the instrument.

The addition of this support bracket requires no notable modification of the utensil, and in particular of its stand, except for the drilling of two small holes into the side parts of the stand, thereby contributing to the simple and economic nature of the solution provided.

The support bracket can be mounted and demounted without a tool, on account of the fact that it is simply inserted by way of the two ends of the stirrup into the two holes drilled in the stand of the utensil, the "spring" effect of the metal wire enabling the user or other operator to manually pinch the stirrup in particular in order to disengage its ends.

Having a suitable size, the support bracket adapts easily to all types of horizontal worktop, whatever the thickness, material or form thereof or the profile of the edges thereof, etc.

The support bracket can also be used on substrates other than worktops, in particular on containers used in kitchens. The support bracket engages in this case with a rim of the container, making the utensil stable during such a use, while leaving sufficient free space under the utensil for the work to be carried out, and thus avoiding additional handling of the products sliced with the aid of the utensil when these products need to be cooked in the same container.

Finally, the support bracket in the form of a stirrup offers the possibility of storing the utensil by hanging it by this stirrup, with its stand folded in, under a shelf or on a wall: the utensil is then protected from any deterioration by contact or impact with another utensil or piece of equipment, this occurring frequently in kitchens. The stirrup also makes it easy to manually grasp the utensil with no risk to the user's fingers, in particular in order to take hold of the instrument when it is stored loose or stacked with other utensils, its cutting blades then not being very visible to the user.

BRIEF DESCRIPTION OF THE DRAWINGS

The invention will be better understood with the aid of the following description, with reference to the appended schematic drawing showing, by way of example, an embodiment of this support bracket for vegetable cutting utensils, and illustrating modes of use of this support bracket.

DETAILED DESCRIPTION

Figure 1:
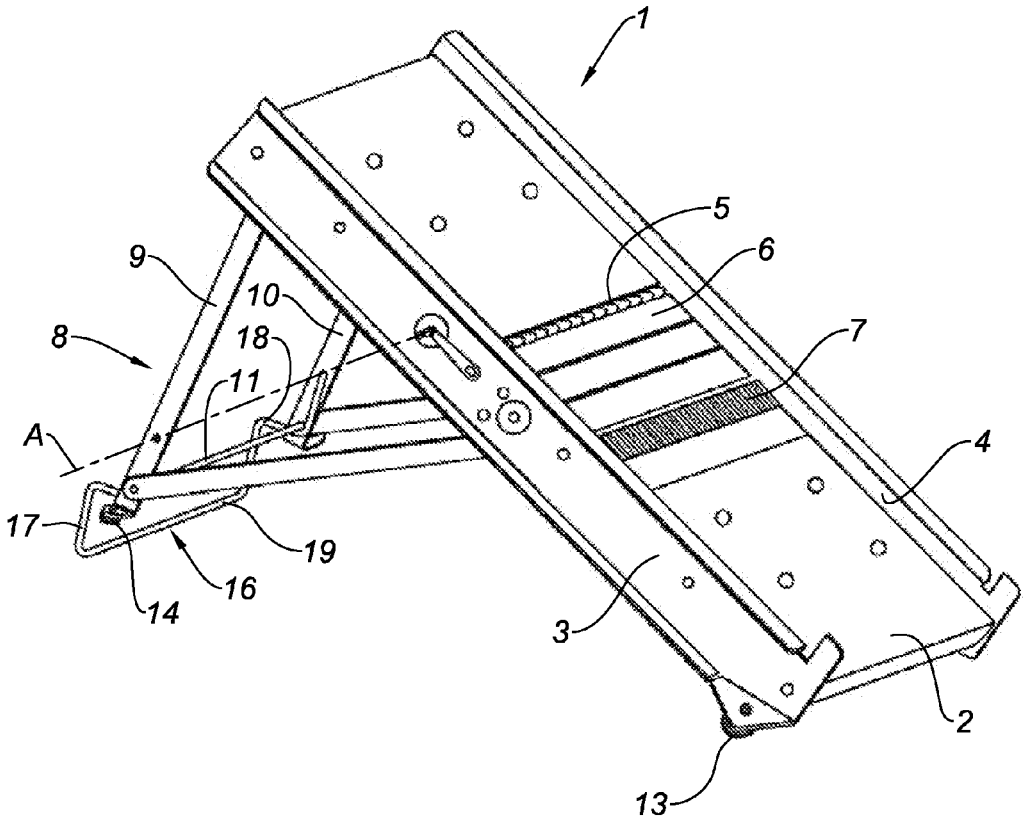
FIG. 1 is an assembly view, in perspective, of a utensil equipped with the support bracket according to the invention, shown in its deployed use position.

The figures show a manually operated vegetable cutting utensil of the type known as a "mandolin", designated as a whole by the reference 1, and comprising a large rectangular plate 2 inserted into a frame composed of two side sections 3 and 4. The plate 2 is interrupted in its middle region, at the mid-point of the length of the sections 3 and 4, where a plurality of parallel cutting blades 5, 6 and 7 are located and comprise, for example, a smooth blade and a wavy blade, the height of which with respect to the plate 2 can be adjusted.

Towards its rear end, the utensil has a foldable stand 8 including two side parts 9 and 10 connected together by a transverse connecting rod 11. In the use position on a horizontal worktop 12 (see FIG. 3), the stand 8 is deployed, thus enabling the utensil to take up an inclined position with respect to the worktop 12: the front of the utensil rests directly on the horizontal surface of the worktop 12, optionally via non-slip feet 13, while the rear of the utensil is lifted and rests via the stand 8, optionally provided at its bottom with other non-slip feet 14, on the horizontal surface of the worktop 12, close to one edge 15 of this worktop 12.

Figure 2:
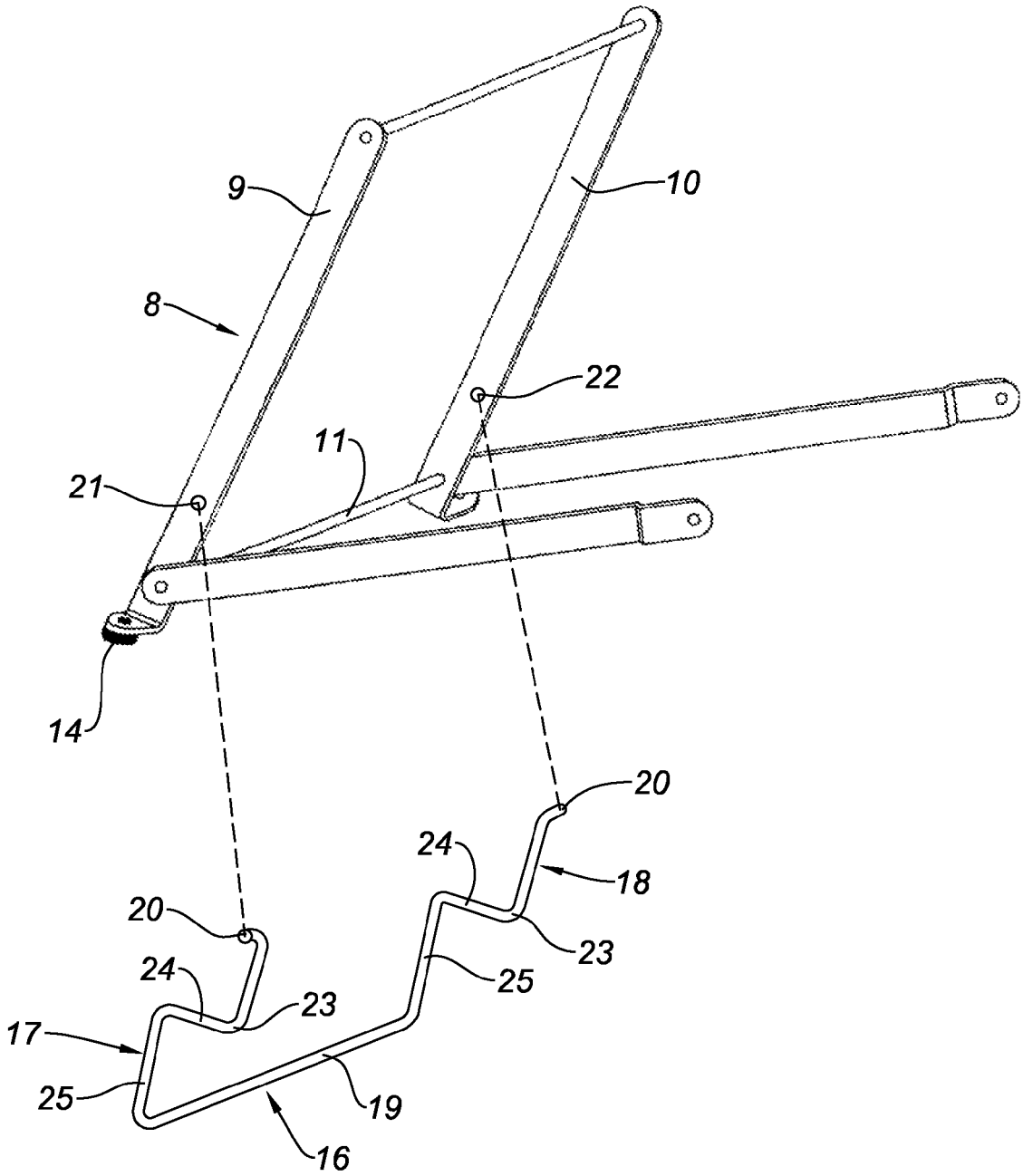
FIG. 2 is an exploded detail view in perspective, showing the stand of the utensil in FIG. 1 and the corresponding support bracket separate from this stand.

According to the invention, and as shown more particularly in FIG. 2, the utensil is equipped with a support bracket, designated as a whole by the reference 16, which is joined to the stand 8, more particularly to the bottom of this stand 8.

The support bracket 16 is in the form of a stirrup, made of stainless steel wire, having two side arms 17 and 18 connected together by an intermediate transverse part 19. Each side arm 17 or 18 comprises, starting from its free end:

- this free end 20, folded at right angles and inserted into a corresponding hole 21 or 22, respectively, pierced into the corresponding side part 9 or 10 of the stand 8;
- a curved mid-part 23;
- a functional part, i.e. having an abutting function, itself comprising a first portion 24 extending the curved mid-part 23 and a second portion 25 perpendicular to the first portion 24, said second portion 25 being attached to one end of the intermediate transverse part 19.

The insertion of the respective free ends 20 of the two side arms 17 and 18 of the stirrup into the corresponding holes 20 and 21 constitutes a transverse axis A for pivoting the stirrup relative to the stand 8 of the utensil. The stirrup is thus mounted able to pivot between a deployed use position (FIGS. 1, 3 and 4) and a folded-away storage position (FIG. 5).

Consideration will more particularly be given to the deployed use position, in which the curved mid-parts 23 of the two side arms 17 and 18 of the stirrup rest under the transverse rod 11 of the stand 8, thereby defining said position with precision. In this position, with the stand 8 itself being deployed, the first portion 24 of the functional part of each side arm 17 or 18 of the stirrup is aligned horizontally, while the second portion 25 of this functional part is aligned vertically and directed downwards.

Figure 3:
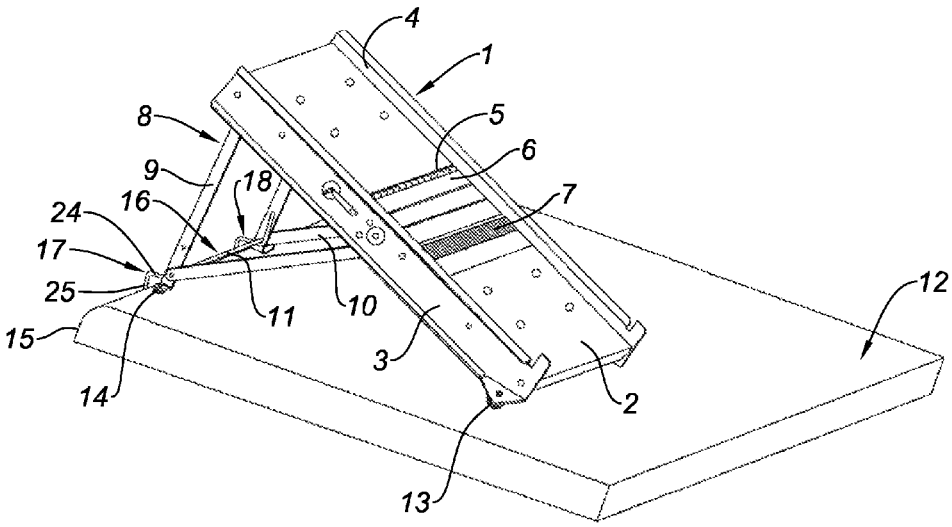
FIG. 3 is a view in perspective illustrating the use of the utensil in FIGS. 1 and 2 on a worktop.

Thus, when the utensil 1 is used on a worktop 12, as shown in FIG. 3, the horizontal first portion 24 of each side arm 17 or 18 of the support bracket 16 rests on the surface of the worktop 12, right next to the edge 15 of this worktop, while the vertical second portion 25 of each side arm 17 or 18 butts against the edge 15 of the worktop. The utensil 1 is then immobilized, and in particular there is no risk of it slipping on the worktop 12, even if the latter is wet or greasy, under the effect of the horizontal component of the force deployed to slice vegetables or fruits by means of one of the cutting blades 5, 6 and 7.

Figure 4:
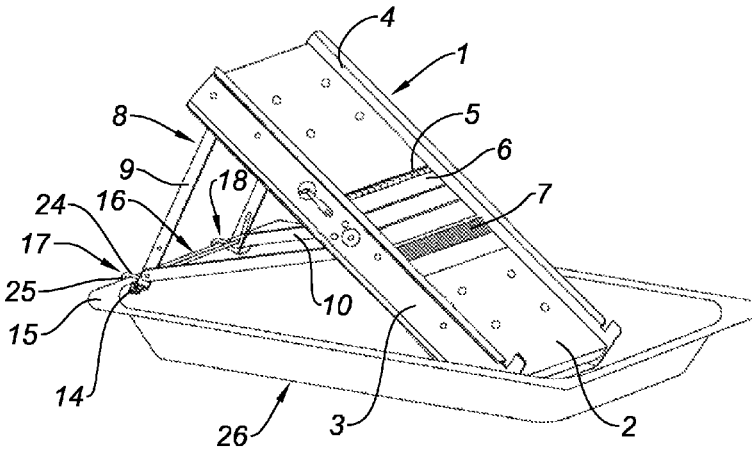
FIG. 4 is a view in perspective illustrating the use of the same utensil on a container.
Figure 5:
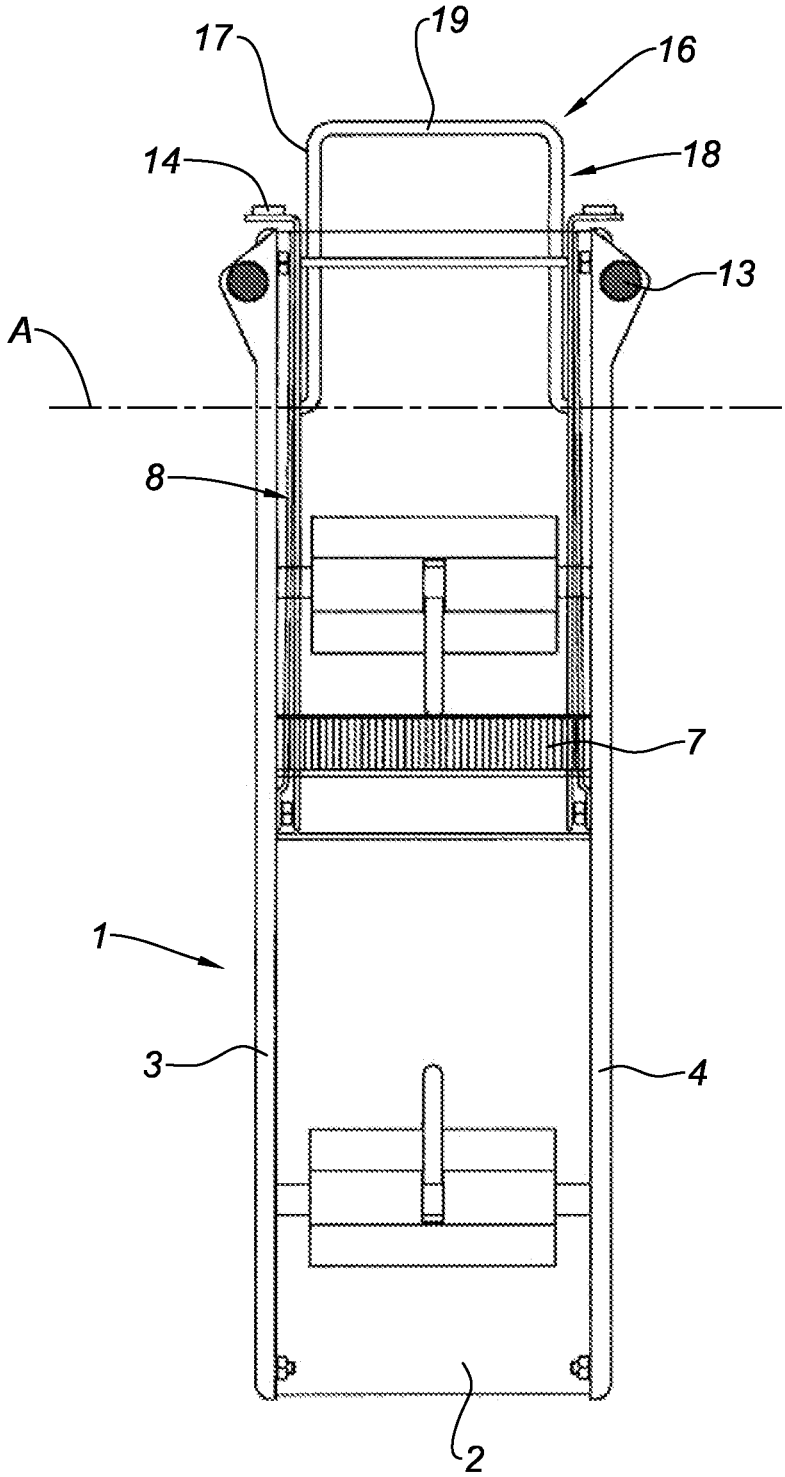
FIG. 5 shows a bottom view of the utensil in the preceding figures in the folded storage or hanging position.

As illustrated in FIG. 4, the support bracket 16 is also suitable for immobilizing the utensil 1 on an edge of a container 26 usually used in kitchens, in particular a container known as a "food container". In this case, the front part of the utensil 1 rests on the base of the container 26 in which the slices or sticks cut out of the vegetables or fruits are directly received.

Finally, FIG. 5 shows the configuration of the utensil and its support bracket 16 in the non-use position. The stand 8 is folded flat under the large rectangular plate 2 and the support bracket 16 is in turn folded away by pivoting about the axis A. In this folded position, the utensil 1 can be stored away flat. It can also be hung, under a shelf or on a wall, by its support bracket 16 in the form of a stirrup, in particular by the intermediate transverse part 19 of this stirrup, which protrudes beyond the plate 2, as shown in this figure.

There is no departure from the scope of the invention:

by modifying the forms of detail of the support bracket;

by producing this support bracket from any suitable material;

by hinging said support bracket on the utensil by any means;

by optionally providing two or more holes on each of the side parts of the stand of the utensil, offering a choice of positions for mounting the support bracket in a pivoting manner;

by intending this support bracket for utensils having other features, for example cutting blades of different types and/or in a different number, it being possible for these utensils to be intended for professional kitchens or for domestic use by individuals.

What is claimed is:

1. Support bracket for a manually operated vegetable cutting utensil, the utensil having a stand for keeping the utensil in an inclined position on a horizontal worktop or other substrate while in used, the support bracket being installed at a bottom of the stand of the utensil and being provided to butt, in the use position, against an edge of the worktop or other substrate so as to stabilize the utensil, wherein the support bracket is made of metal wire bent to form a stirrup, and two side arms of which are mounted are configured to pivot about a transverse axis, on respective side parts of the stand of the utensil, the stirrup thus configured to pivot between a deployed use position and a folded-away storage position, and wherein the two side arms of the stirrup forming the support bracket each comprise:

a free end bent at right angles and inserted into a hole pierced into a corresponding side part of the stand of the utensil, so as to produce the transverse axis to pivot the stirrup, a curved mid-part configured to rest under a transverse rod connecting the two side parts of the stand of the utensil so as to define an angular position of use of the support bracket, and a functional part, comprising:

continuing the curved mid-part, a first portion which is approximately horizontal in the deployed use position and is configured to rest on the surface of at least one of the worktop and an other substrate; and on the other side of the first portion, a second portion which is approximately vertical in the deployed use position, this second portion configured to press against an edge of the at least one worktop and the other substrate.

2. A utensil configured to perform at least one manual cutting operation, the utensil comprising:

a stand to maintain the utensil in an inclined position on at least one of a horizontal worktop and other substrate during the at least one manual cutting operation; and a support bracket as claimed in claim 1, the support bracket being installed at the bottom of the stand.

3. The utensil of claim 2, wherein the utensil is a mandolin.

4. The utensil of claim 2, wherein the utensil comprises a large rectangular plate inserted into a frame composed of two side sections, the plate being interrupted in its middle region, at the mid-point of the length of the sections where a plurality of cutting blades are located.

* * * * *